US009970289B2

(12) United States Patent
O'Reilly et al.

(10) Patent No.: US 9,970,289 B2
(45) Date of Patent: May 15, 2018

(54) METHODS AND SYSTEMS FOR ASSESSING PRODUCTIVITY OF A BEAM PUMPED HYDROCARBON PRODUCING WELL

(71) Applicant: Chevron Australia Pty. Ltd., Perth (AU)

(72) Inventors: Daniel Ian O'Reilly, Perth (AU); Matthew Alexander Flett, Perth (AU)

(73) Assignee: CHEVRON U.S.A. INC., San Ramon, CA (US)

( * ) Notice: Subject to any disclaimer, the term of this patent is extended or adjusted under 35 U.S.C. 154(b) by 268 days.

(21) Appl. No.: 14/860,750

(22) Filed: Sep. 22, 2015

(65) Prior Publication Data

US 2017/0081957 A1 Mar. 23, 2017

(51) Int. Cl.

| | |
|---|---|
| ***E21B 49/00*** | (2006.01) |
| ***E21B 47/06*** | (2012.01) |
| ***E21B 43/12*** | (2006.01) |

(52) U.S. Cl.
CPC ..... *E21B 49/00* (2013.01); *E21B 43/127* (2013.01); *E21B 47/06* (2013.01)

(58) Field of Classification Search
CPC ..... E21B 49/00; E21B 43/127–43/129; E21B 43/125; E21B 43/121; E21B 43/12
See application file for complete search history.

(56) References Cited

PUBLICATIONS

Ali M. Al-Khatib, Improving Oil and Gas Production With the Beam-Mounted Gas Compressor, Feb. 1984, Journal of Petroleum Technology, pp. 276-280.*
Earlougher, Jr., Robert C.; "Advances in Well Test Analysis"; Second Printing, (1977), Title, Dedication, Table of Contents, Acknowledgment, Preface pages, pp. 1-59.
(Continued)

*Primary Examiner* — Toan Le
(74) *Attorney, Agent, or Firm* — Karen R. DiDomenicis

(57) ABSTRACT

Disclosed are methods and systems for characterizing an intermittently produced beam pumped hydrocarbon producing well that is controlled by a Type II pump off controller. The well is operated at production pumping conditions while a pressure signal and/or a production rate signal is monitored, without the need for a conventional pressure-buildup shut in period to obtain well data. A set of theoretical type curves is plotted using a type curve algorithm that successively solves for the duration of each producing time ($\Delta t_{pN}$). A dimensionless curve of the percentage run time versus the number of production cycles for the well is also plotted. The theoretical type curve closest matching the dimensionless curve is identified. From the closest matching type curve, $\Delta t_{p1}/\Delta t_s$ is determined wherein $\Delta t_{p1}$ is the amount of time for a first production period of the well and $\Delta t_s$ is an operator defined shut in period, and $\Delta t_{p1}$ is calculated. A well property selected from the group consisting of formation permeability, skin, productivity index and combinations thereof can be calculated using the well data and $\Delta t_{p1}$.

12 Claims, 3 Drawing Sheets

(56) References Cited

PUBLICATIONS

Earlougher, Jr., Robert C.; "Advances in Well Test Analysis"; Second Printing, (1977), pp. 60-127.
Earlougher, Jr., Robert C.; "Advances in Well Test Analysis"; Second Printing, (1977), pp. 128-195.
Earlougher, Jr., Robert C.; "Advances in Well Test Analysis"; Second Printing, (1977), pp. 196-264.
Ehlig-Economides, Christine Anna; "Well Tested Analysis for Wells Produced at a Constant Pressure"; a Dissertation, Jun. 1979, Information to Users, Title, Acknowledgements, Abstract, and Table of Contents, pp. i-viii, and pp. 1-55.
Ehlig-Economides, Christine Anna; "Well Tested Analysis for Wells Produced at a Constant Pressure"; a Dissertation, Jun. 1979, pp. 56-117.
Lee, John, et al.; "Pressure Transient Testing"; SPE Textbook Series, vol. 9, (2003), Title, Dedication, Introduction, Acknowledgments, Table of Contents pp., pp. 1-54.
Lee, John, et al.; "Pressure Transient Testing"; SPE Textbook Series, vol. 9, (2003), pp. 55-118.
Lee, John, et al.; "Pressure Transient Testing"; SPE Textbook Series, vol. 9, (2003), pp. 119-182.
Lee, John, et al.; "Pressure Transient Testing"; SPE Textbook Series, vol. 9, (2003), pp. 183-245.
O'Reilly, Daniel I., et al.; "Pressure and Rate Transient Analysis of Artificially Lifted Drawdown Tests Using Cyclic Pump Off Controllers"; Journal of Petroleum Science and Engineering, vol. 139, (2016), pp. 240-253.

* cited by examiner

METHODS AND SYSTEMS FOR ASSESSING PRODUCTIVITY OF A BEAM PUMPED HYDROCARBON PRODUCING WELL

FIELD

The present disclosure relates to methods and systems for utilizing available pressure and/or rate data from a producing beam pumped hydrocarbon producing well to assess and enhance productivity of the well.

BACKGROUND

Artificial lift systems, such as sucker rod systems, also referred to as beam pumped systems, are widely used to mitigate the pressure decline in hydrocarbon producing wells over time. Such systems are used in both conventional oil and gas fields and unconventional oil and gas fields (e.g., shale oil and coalbed methane, where formations must be dewatered prior to hydrocarbon production). Artificial lift is installed in wells that are no longer capable of lifting fluids to the surface using the reservoir's natural energy. In these completions, a rod string is connected to a plunger that actuates a ball and seat valve downhole. These wells were originally allowed to run twenty-four hours per day. Eventually operators discovered that this was contributing to the failure of pump components as the pump was often not properly primed with reservoir fluids downhole. For some portion of the day, the reservoir was so depleted that the pump plunger would pound against a low fluid level.

Artificial lift wells that are operated by cyclic pump off controllers, or simply "pump off controllers" or POCs, are stopped and started intermittently based on the controller logic. POCs were invented to offer a way for operators to produce a well for a period of time and stop the pump from reciprocating for the remainder of the day. Type II POCs generally utilize sensors for monitoring pump conditions. For instance, load cells can be used to measure the load on a beam pump, which is an indication of the fluid level in the well. When the fluid level reaches a minimum acceptable limit, the load on the beam pump will be at a maximum acceptable limit. When this limit is reached, a condition referred to as "pump-off," the POC shuts down production of the well for a period of time to allow fluid to enter the well. This period of time is generally predetermined by the POC operator. As a result, the transient pressure and rate behavior of beam pumped wells is quite complicated.

In the field of reservoir and production engineering, it is frequently important to assess the productivity of an intermittently produced beam pumped hydrocarbon producing well, also referred to herein interchangeably as a well or its associated reservoir, in what is referred to as a well transient test. This test may be conducted to determine reservoir properties including permeability-thickness (kh) and skin (s). Permeability-thickness is the flow capacity of the gross reservoir rock or well formation at a reasonable distance away from the wellbore. Skin is a dimensionless factor that quantifies any near-wellbore damage that might have occurred to the flow properties of the rock over the life of production of an artificially lifted well, known to contribute to the productivity of the well. Conventionally, this involves shutting in the well, i.e., ceasing production or flow from the well, and then monitoring the well using sensors such as pressure sensors. As is well known, when a well is closed after a long period of production, a slow increase in the shut-in wellbore pressure occurs, as the reservoir returns to equilibrium. Normally engineers use the change in this pressure over time to quantify reservoir characteristics. An example of this is what is known as a pressure buildup survey, also referred to as a build-up analysis. Analysis of the pressure and/or rate transient signals provides an indication of the productivity of the well and reflects the permeability of the reservoir formation, also referred to as formation permeability which is an indication of rock quality. Knowing the formation permeability surrounding a reservoir enables a reservoir operator or engineer to determine beam pump operating parameters that will result in enhanced productivity of the oilfield. Such operating parameters include amount of time the beam pump is running and amount of time the beam pump is off. Such on/off settings are controlled by cyclic pump off controllers. Knowing the formation permeability surrounding a reservoir also enables a reservoir operator or engineer to identify producing wells with poor productivity and potentially high skin, so that a work-over rig can be used to stimulate or remediate the well.

During reservoir production using intermittently produced beam pumping systems, pressure and rate transients occur because of the beam pump being turned on and off. These transients are much like the transient production that occurs when an artificially lifted well restarts after a period of inactivity. This transient production is known in the art as a drawdown test. Different types of drawdown tests can occur. In one case, referred to as constant rate production, the production rate is held constant and variation in bottomhole flowing pressure is observed. The "line source solution" as described in Lee, J., Rollins, J., and Spivey, J., [Pressure Transient Testing], SPE textbook series, Society of Petroleum Engineers (2003) to this flow condition for an infinite reservoir is one of the most widely used equations in pressure and rate transient analysis. When combined with superposition or convolution analysis, the solution can be applied to a wide range of producing wells. In a second type of drawdown test, referred to as constant pressure production, the pressure at the reservoir sandface is maintained at a constant while the production rate declines as a transient. This boundary condition is less well-known than the line source solution, however several solutions have been presented previously, as described in Ehlig-Economides, C. A., Well Test Analysis For Wells Produced At Constant Pressure, PhD thesis, Stanford University (1979). Unfortunately, these solutions are less mathematically convenient than the line source solution, and the inversion from Laplace space must be done numerically. Many simplifications have been proposed, and the simplest is that a rearrangement of the logarithmic line source solution can be acceptable at higher values of dimensionless time. See Earlougher, R. C., [Advances in Well Test Analysis], Society of Petroleum Engineers of AIME (1977).

As aging oilfields can have hundreds of beam pumped wells producing under artificial lift, it is not economical to perform a conventional well assessment test on all wells since this would result in lost production. It would be desirable to have a simpler, quicker, more cost-effective method for estimating the reservoir properties such as formation permeability and productivity of a producing well without the need for shutting in the well, particularly when pump off controllers are used.

SUMMARY

In one aspect, a method is provided for assessing the productivity of an intermittently produced beam pumped hydrocarbon producing well. The intermittently produced beam pumped hydrocarbon producing well has a percentage run time and a number of production cycles. The well is operated at production pumping conditions while a pressure signal and/or a production rate signal is monitored, without the need for a conventional pressure-buildup shut in period to obtain well data. A set of theoretical type curves is plotted using an algorithm, referred to herein as the "type curve algorithm," that successively solves for the duration of each producing time ($\Delta t_{pN}$), using equation (1) below.

$$\text{Solving for } \Delta t_{(D_p)N} \tag{1}$$

$$\begin{cases} 0.4452 * 10^{0.868(PD_p - s)} = \Delta t_{(D_p)1}, & N = 1 \\ 0.4452 * 10^{0.868(PD_p - s)} = \dfrac{\prod_{i=1}^{N}\left[\sum_{j=1}^{N}\left(\Delta t_{(D_p)j}\right) + (N-i)\Delta t_{(D_p)}\right]}{\prod_{i=2}^{N}\left[\sum_{j=1}^{N}\left(\Delta t_{(D_p)j}\right) + (N+1-i)\Delta t_{(D_p)}\right]}, & N > 1 \end{cases}$$

A dimensionless curve of the percentage run time versus the number of production cycles for the well is also plotted. The theoretical type curve closest matching the dimensionless curve is identified. From the closest matching curve, $\Delta t_{p1}/\Delta t_s$ is determined wherein $\Delta t_{p1}$ is the amount of time for a first production period of the well and $\Delta t_s$ is an operator defined shut in period, and $\Delta t_{p1}$ is calculated. Finally, a well property selected from the group consisting of formation permeability, skin, productivity index and combinations thereof is calculated using the well data and $\Delta t_{p1}$ as calculated.

In another aspect, a system is provided for controlling production of a hydrocarbon producing well. The system includes a beam pump for lifting fluid from a hydrocarbon producing well, a pump off controller for controlling the operation of the beam pump based on pre-set conditions determined by an operator such that when pump-off is detected in the hydrocarbon producing well, the beam pump is shut down for a pre-set amount of time to allow entry of fluid into the hydrocarbon producing well. The pump off controller includes sensors for gathering well data and microprocessors. The system further includes a processor for analyzing the well data using the type curve algorithm to obtain a well property selected from the group consisting of permeability, skin, productivity index and combinations thereof.

DESCRIPTION OF THE DRAWINGS

These and other objects, features and advantages of the present invention will become better understood with reference to the following description, appended claims and accompanying drawings where:

DETAILED DESCRIPTION

Throughout the following description, the following nomenclature is used:

$\Delta p_s$ Pressure loss due to skin (psi)
$\Delta t_{Dp}$ Producing time
$\Delta t_{Ds}$ Shut-in time
μ Viscosity (cP)
$p'_D$ Dimensionless pressure, averaged from cycle 1 to cycle C
$p'_D$ Dimensionless pressure, averaged over a single cycle C
$q'_D$ Fluid rate, averaged over a single cycle C
φ Porosity (pu)
$q'_D$ Dimensionless rate in Laplace space
B Formation Volume Factor (rb/stb)
C Total number of cycles
c Cycle index used in summation
$c_t$ Total compressibility (1/psi)
h Thickness (ft)
k Index for production or shut-in interval, or permeability (mD)
k' Total permeability (mD) including effect of skin
n Total number of production and shut-in intervals
p Pressure (psi)
$p_D$ Dimensionless pressure
$p_i$ Initial reservoir pressure (psi)
$p_sD$ Dimensionless pressure including skin
$p_{wf}$ Bottomhole owing pressure (psi)
q Fluid rate (bbl/day)
$q_D$ Dimensionless rate
$r_D$ Dimensionless radius
$r_w$ Radius of wellbore (ft)
s Skin
t Time (hrs)
$t_D$ Dimensionless time
log Logarithm (base 10)

Figure 1:
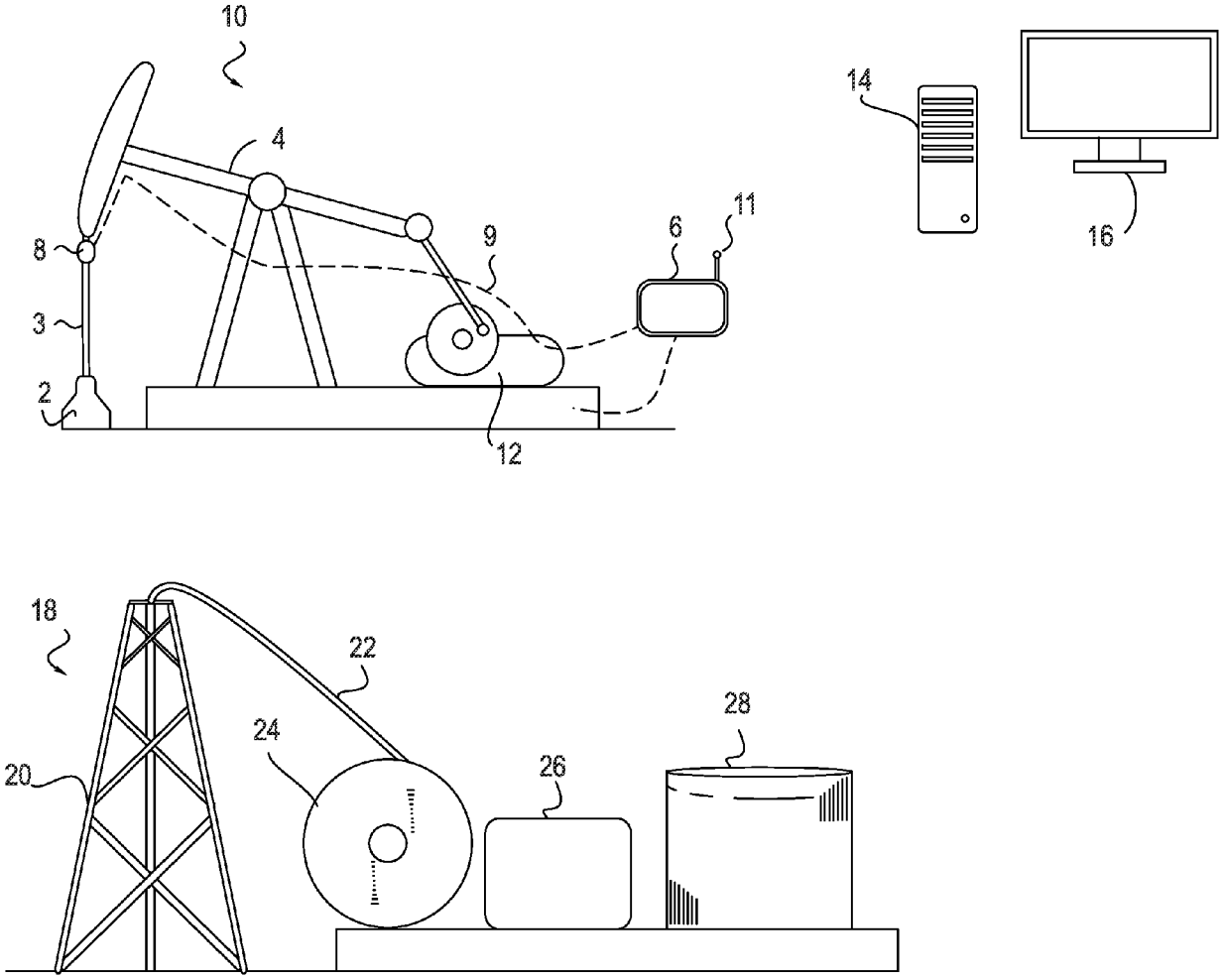
FIG. 1 is a schematic diagram illustrating an intermittently produced beam pumping system according to an exemplary embodiment.

In the following description, reference will be made to FIG. 1 illustrating an intermittently produced beam pumping system 10 according to some embodiments. A hydrocarbon producing well 2 is intermittently produced by a beam pump 4. The operation of the beam pump 4 is controlled by a Type II pump off controller (POC) 6 connected to the beam pump 4. The beam pump 4 is connected to the wellhead 2 by rods 3. A motor 12 is used to drive the beam pump 4.

Pump off controllers can be based on a timer, in which the well will produce for a specified duration ($\Delta t_{Dp}$ in dimensionless terms), and is then shut in for another period of time ($\Delta t_{Ds}$). This type of POC is known as a Type I or interval timer controller. Another variation of the Type I controller is known as a percentage timer, where the well operates a fixed percentage of the day. Suitable pump off controllers 6 for use in the present systems and methods are Type II pump off controllers 6 which include the addition of a load cell 8 that measures the force exerted on the beam pump 4. Line 9 connects load cell 8 to POC 6. This allows for real time tracking of the fluid load in the pump and control based on the current inflow conditions. When inflow has almost ceased and the fluid level in the well is low, the sucker rod plunger of the beam pump may pound against a partially filled chamber. When this occurs, the Type II POC 6 will automatically switch off the well within a predefined tolerance. It then shuts down for a specified amount of time ($\Delta t_{Ds}$). The only the time that the well 2 is shut in is set inside the controller 6; the producing time varies and is purely controlled by the well's inflow.

After the well 2 is brought online, cycle times will gradually diminish as the well 2 settles into pseudo steady or steady state production. Commonly, SCADA (Supervisory Control and Data Acquisition) systems record this information. The diminishing cycle time can then be used for drawdown interpretation. The runtime data should be correlated against separator well test rates to predict phase rates during well startup. Alternatively, if the well 2 is continuously monitored under multiphase metering, those data should be used. For best quality of drawdown data, also referred to herein as well data, it is suggested that both pressure and rate data are acquired. Normalized semi-log analysis can be used to interpret the well data. In one embodiment, pressure data are not obtained. Thus analysis is based on knowing the fluid pound pressure alone, i.e., knowing the pressure at each time when the POC 6 shuts in the well. If continuous pressure and rate data are both available, it is possible to use the equations developed within to match directly p(t) or p(t) by adjusting well properties in the proposed models. In some cases it may be preferred to match p(t), which is defined as the average flowing bottom hole pressure (FBHP) during a single cycle.

In one embodiment, an algorithm is developed to convert the unsteady, cyclic operation of the POC controller 6 into smoothed and averaged data that are suitable for semi-log analysis. The general principal applied is the superposition of constant rate production and shut-in periods using the readily available infinite acting radial flow solution for constant rate production. Superposition can be used on partial differential equations that are linear or have been linearized and involves combining many solutions across different time periods. The well 2 is then modelled as a series of alternating constant-rate production and shut-in periods.

The terms "POC" and "Type II POC" are used herein interchangeably. In one embodiment, production rate data is used. Bottom hole pressure is optionally used if available. If pressure data are not available, the presently disclosed method utilizes the fact that the Type II POC 6 stops the beam pump 4 at a known bottomhole pressure during each cycle. This is achieved through a load cell measurement device 8, which measures the load on the beam pump 4. The POC monitors the load cell device 8 until inflow into the well 2 has ceased and bottomhole pressure has reached a certain inferred value.

A mathematical model can be developed to represent characteristics of the intermittently produced beam pumped hydrocarbon producing well 2 as it undergoes transient production. The mathematical model can be applied to wells with little or no well bore storage. Examples are artificially lifted wells where the annulus is separated with a packer (or a casing pump), or wells with a small producing annulus. The present disclosure will describe how such a mathematical model can be used with semi log analysis to create a set of curves for assessing productivity of a producing well 2. As the beam pumped well 2 is brought online, its production rate declines in a defined manner that may be used to derive formation permeability using the set of curves.

After starting production, analysis using a Type II POC 6 can behave like a classical constant-pressure drawdown analysis, providing that corrections are applied before well data interpretation. Provided wellhead backpressure and pump setting depth are known, the bottom hole pressure (BHP) may be assumed constant and hence a gauge or fluid level tests are not required. This is a distinct advantage of the Type II controller in terms of data analysis. Rate data are required for this analysis. In this type of well, the BHP is only allowed to decline to the fluid pound pressure, $p_{Dp}$, before the well is forcibly shut in by the POC controller 6, after time $\Delta t_{Dp1}$. This is measured by the load cell 8 on the surface. The pump 4 stops for duration $\Delta t_{Ds}$ and this ends one cycle. For the next cycle, the well 2 produces for a shorter duration $\Delta t_{Dp2}$, due to the nature of infinite acting radial flow, before it is again shut-in for $\Delta t_{Ds}$ duration. For C number of cycles, it can be observed that $\Delta t_{Dp1} < \Delta t_{Dp2} < \ldots < \Delta t_{DpC}$. This is a result of the average near-wellbore pressure depleting during drawdown. The amount withdrawn each cycle decreases. The average production rate of the well 2 during this period hence declines over time, similar to a constant-BHP drawdown test.

In one embodiment, a method is provided for assessing the productivity of the intermittently produced beam pumped hydrocarbon producing well 2. In one embodiment of the method, certain data are required. For instance, pumping percent run time, also referred to as percentage run time, number of cycles, a description of the depth of the well 2, and its hole size are required to predict pressures referred to in the above paragraph. The formation characteristics typical of pressure transient analysis, i.e., total compressibility, porosity, viscosity, radius of wellbore and formation volume factor (FVF), are used in the calculations to back-calculate formation permeability. A certain number of reservoir parameters must be known a priori, as is normally the case in well testing theory. In one embodiment, formation permeability and/or skin are the unknowns that are solved for, and all the other constants referred to above are used in the calculation process to infer them. The percentage run time can be defined as the amount of time that the well is producing divided by the total amount of time that the well is producing and shut-in, over a period of time. This percentage declines over a period of time. Each period of production and subsequent period of shut-in can be defined as one production cycle. The well has an associated number of production cycles over a given period of time. Over time, the well will perform many cycles during its natural production performance.

A set of theoretical type curves for an intermittently produced beam pumped hydrocarbon producing well 2 can be plotted using a type curve algorithm, represented below:

Solving for $\Delta t_{(D_p)N}$ (1)

$$\left\{\begin{array}{ll} 0.4452 * 10^{0.868(PD_p - s)} = \Delta t_{(D_p)1}, & N = 1 \\ 0.4452 * 10^{0.868(PD_p - s)} = \dfrac{\prod_{i=1}^{N}\left[\sum_{j=1}^{N}\left(\Delta t_{(D_p)j}\right) + (N-i)\Delta t_{(D_p)}\right]}{\prod_{i=2}^{N}\left[\sum_{j=1}^{N}\left(\Delta t_{(D_p)j}\right) + (N+1-i)\Delta t_{(D_p)}\right]}, & N > 1 \end{array}\right\}$$

Figure 2:
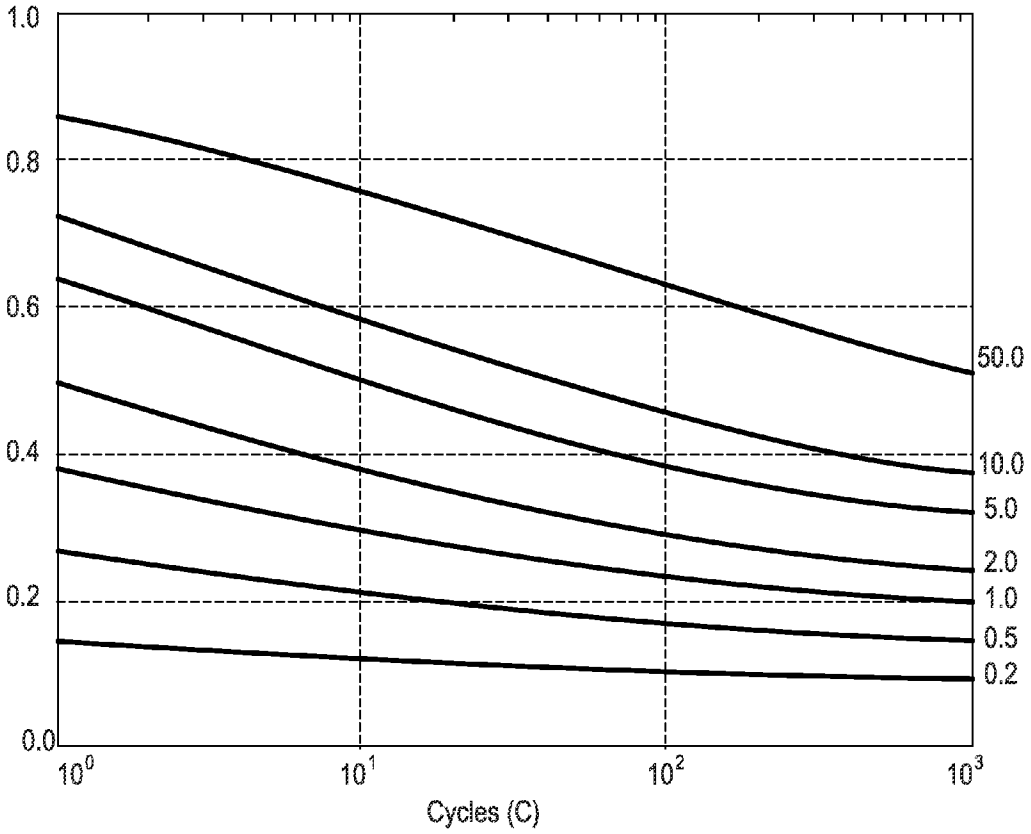
FIG. 2 is a set of theoretical type curves is plotted using an algorithm according to an exemplary embodiment.

FIG. 2 is a graphical representation of a set of theoretical type curves plotted according to equation (1). Each of the curves is referred to as a type curve. The figure has been prepared through the solution of the type curve algorithm sequentially for each cycle of the intermittently produced beam pumped hydrocarbon producing well 2 For a particular type curve, a defined $\Delta t_{p1}$ and $\Delta t_s$ are chosen to form a particular ratio of $\Delta t_{p1}/\Delta t_s$. In FIG. 2, the ratios 50, 10, 5, 2, 1, 0.5 and 0.2 were chosen. For Cycle 1, i.e., the first cycle, the production time ($\Delta t_{p1}$) then defines the constant on the left hand side of the equation. For subsequent cycles (N>1), the lower equation of the type curve algorithm is used to solve for each subsequent production time, i.e., $\Delta t_{pN}$.

Finally, this may be plotted for each cycle N as a ratio against total cycle time, thus dimensionalizing the chart and making it ready for engineering use.

The set of theoretical type curves is used in the present method as reference curves to which curves representing well data from a producing well 2 are compared to assess productivity of the well 2.

Figure 3:
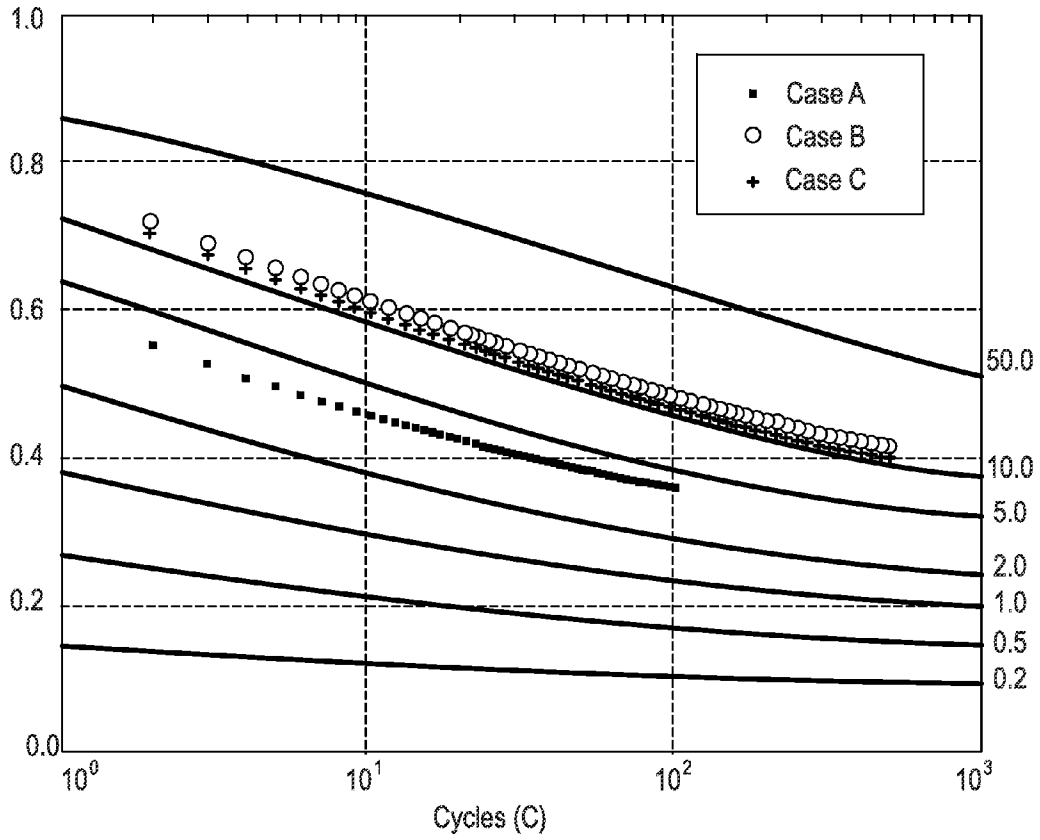
FIG. 3 is an example of dimensionless curves of percentage run time versus number of production cycles for producing wells laid over the set of theoretical type curves according to an exemplary embodiment.

In one embodiment, a dimensionless curve of the percentage run time versus the number of production cycles for the well 2 over a total given period of time is plotted as shown in FIG. 3. The resulting dimensionless plot is prepared using a polynomial solution method as derived below.

Assuming the equation for the convolved dimensionless pressure of the POC controller 6 (developed through superposition of producing and shut-in periods):

$$p_{D_n}(t_D, n) = \sum_{k=1,odd}^{n}\left\{p_D\left[t_D - \sum_{j=1}^{\frac{k-1}{2}}\Delta t_{(D_p)j} - \frac{k-1}{2}\Delta t_{D_s}\right] + s\right\} - \sum_{k=2,even}^{n}\left\{p_D\left[t_D - \sum_{j=1}^{k/2}\Delta t_{(D_p)j} - \frac{k-2}{2}\Delta t_{D_s}\right] + s\right\} \tag{2}$$

The producing duration ($\Delta t_{p1}$) varies for each cycle and is not a constant. The odd values of k apply to producing times and the even values apply to shut-in periods.

The logarithmic approximation for $p_D$ is used, and the equation is rearranged so that the skin term only appears during production periods:

$$\frac{p_{D_n}[(-1)^n + n\bmod 2]s}{1.152} = \sum_{k=1,odd}^{n}\log\left[2.246\left(t_D - \sum_{j=1}^{\frac{k-1}{2}}\Delta t_{(D_p)j} - \frac{k-1}{2}\Delta t_{D_s}\right)\right] - \sum_{k=2,even}^{n}\log\left[2.246\left(t_D - \sum_{j=1}^{k/2}\Delta t_{(D_p)j} - \frac{k-2}{2}\Delta t_{D_s}\right)\right] \tag{3}$$

Equation (3) is solved for the $\Delta t_{pj}$ terms. Now that the equation is in terms of the logarithmic solution, these terms are more easily isolated by removing the $t_D$ variable. The following equation is obtained by examining the end of each production period. The below equation, i.e., the type curve algorithm, applies at the end of each production period only. The number of the production period, N, is defined as N=(n+1)/2.

Solving for $\Delta t_{(D_p)N}$ (4)

$$\begin{cases} 0.4452 * 10^{0.868(PD_p - s)} = \Delta t_{(D_p)1}, & N = 1 \\ 0.4452 * 10^{0.868(PD_p - s)} = \dfrac{\prod_{i=1}^{N}\left[\sum_{j=1}^{N}(\Delta t_{(D_p)j}) + (N-i)\Delta t_{(D_p)}\right]}{\prod_{i=2}^{N}\left[\sum_{j=1}^{N}(\Delta t_{(D_p)j}) + (N+1-i)\Delta t_{(D_p)}\right]}, & N > 1 \end{cases}$$

An Nth order polynomial is generated N>1, and may be solved using any equation solving method, such as the secant method. The most economical way to solve the equation using the secant method is in the form:

$$f(\Delta t_{(D_p)N}) = \frac{\prod_{i=1}^{N}\left[\sum_{j=1}^{N}(\Delta t_{(D_p)j}) + (N-i)\Delta t_{D_s}\right]}{\prod_{i=2}^{N}\left[\sum_{j=1}^{N}(\Delta t_{(D_p)j}) + (N+1-i)\Delta t_{D_s}\right]} - 0.4452 * 10^{0.868(p_{D_p} - s)} = 0 \tag{5}$$

Equation (5) is solved successively at each N, knowing the producing time from prior cycles.

In one embodiment, the well 2 is operated at production pumping conditions while a pressure signal and/or a production rate signal may be monitored. The pressure or rate signals can be monitored in any conventional manner. For instance, production rate may be metered using a conventional test separator (not shown) and/or monitored using the POC rate estimation in the POC 6. If required, pressure can be estimated using a sonolog survey tool (not shown) or permanent downhole gauge (not shown). According to one embodiment, the pressure signal and/or rate signal is monitored without shutting in the well to conduct a conventional pressure-buildup survey. An advantage of the present method is that the well does not need to be shut-in, nor does a conventional pressure buildup survey need to be conducted in order to obtain the well data needed for the method. As a result, no production loss is incurred.

As shown in FIG. 3, a dimensionless curve of the percentage run time versus the number of production cycles for the well is plotted. The dimensionless curve is superimposed on the set of theoretical type curves. The theoretical type curve closest matching the dimensionless curve is identified. From the dimensionless curve, $\Delta t_{p1}/\Delta t_s$ can then be determined from the best fitting theoretical type curve. $\Delta t_{p1}$ is the amount of time for a first production period of the well and $\Delta t_s$ is an operator defined shut in period. Since $\Delta t_s$ is set by the operator for the POC operation, it is a known constant, then $\Delta t_{p1}$ follows. Since the ratio $\Delta t_{p1}/\Delta t_s$ was derived from the type curve, this value is multiplied by $\Delta t_s$ to yield $\Delta t_{p1}$.

In one embodiment, a well property, i.e., formation permeability, skin, and/or productivity index for the well 2 can be calculated using the well data and $\Delta t_{p1}$ as calculated above.

In one embodiment, the well property is total formation permeability k' (including the effect of skin), calculated using the equation:

$$k' = -70.64 qB\mu W(-23.9\varphi c_t r_w^2 h\Delta p_p / qB\Delta t_{p1})/h\Delta p_p \tag{6}$$

The well property calculated for the well 2 can be used to identify repairs needed to the well to enhance the recovery of hydrocarbons from the well. In one embodiment, the repairs needed can be included as part of a workover program for maintaining the well.

In one embodiment of the present disclosure, a system 10 is provided for controlling production of a hydrocarbon producing well 2. The system 10 includes a beam pump 4 for lifting fluid from the hydrocarbon producing well 2, a pump off controller 6 for controlling the operation of the beam pump 4 based on pre-set conditions determined by an operator such that when pump-off is detected in the hydrocarbon producing well 2, the beam pump 4 is shut down for a pre-set amount of time to allow entry of fluid into the well 2. The pump off controller 6 includes sensors (not shown) for gathering well data and microprocessors (not shown). The system further includes a processor 14 for analyzing the well data using the type curve algorithm to obtain a well property selected from the group consisting of permeability, skin, and/or productivity index. In one embodiment, the processor 14 can be located remotely from the well site and can receive data wirelessly, transmitted by an antenna 11 associated with the POC 6. The processor 14 can be connected with a monitor 16 for displaying information.

In one embodiment, the pump-off is detected in the hydrocarbon producing well 2 by a load cell strain gauge 8 for measuring load on the beam pump 4.

In one embodiment, the system includes a repair unit 18 for executing a repair to the hydrocarbon producing well 2 based on analysis of the well data. The repair unit 18 can be a work-over rig for replacing components of a well completion. The rig can include a derrick tower 20, one or more spools 24 of cable 22, a diesel engine and/or mud pump 26 and one or more mud tanks 28. These items allow the workover rig 18 to retrieve tubing and rods from the production well 2. The mud pumps allow for the pumping of specialized fluids (e.g. acid or scale treatment) into the rock formation that can repair low permeability areas.

It should be noted that only the components relevant to the understanding of the methods and systems of the disclosure are shown in the figures, and that many other components normally part of a POC-controlled well system are not shown for simplicity.

Example

COMSOL Multiphysics® simulation software (available from COMSOL, Inc., Burlington, Mass.) was used to model radial diffusivity and compare the results with the method of the invention. The type curve algorithm (Equation 1) was used for three separate sets of well properties. The simulation software was used to model each production and shut-in period discretely over time numerically, and the entire producing duration was modeled in the software. This model was then used to illustrate how the methods of the invention can calculate representative formation properties.

The reservoir properties and results of analysis are shown in Table 1.

TABLE 1

| Property | Case A | Case B | Case C |
|---|---|---|---|
| $P_i$ (psi) | 400 | 500 | 500 |
| $p_p$ (psi) | 50 | 375 | 450 |
| $r_w$ (ft) | 0.4 | 0.4 | 0.4 |
| B (rb/stb) | 1.3 | 1.0 | 1.0 |
| μ (cP) | 2.0 | 0.7 | 0.7 |
| φ (pu) | 0.25 | 0.2 | 0.2 |
| $c_t$ (1/psi) | 1e−5 | 3e−4 | 3e−4 |
| h (ft) | 100 | 20 | 20 |
| k (mD) | 10 | 80 | 80 |
| s | 0 | 2 | −2 |

TABLE 1-continued

| Property | Case A | Case B | Case C |
|---|---|---|---|
| $\Delta t_s$ (hr) | 0.5 | 0.15 | 0.15 |
| C (cycles) | 100 | 500 | 500 |
| $q_{pump}$ (stb/d) | 200 | 300 | 300 |
| From type curve: | | | |
| $\Delta t_{p1}/\Delta t_s$ | 4 | 15 | 20 |
| $t_{p1}$ (hr) | 2 | 2.25 | 3 |
| Interpreted k' (mD) | 10.1 | 55.2 | 157.8 |

The proportion of run time vs. number of cycles is shown in FIG. 3. These are the simulation results from COMSOL charted against the theoretical type curves (shown in FIG. 2). The case that each set of points corresponds to is labeled in the legend. It is possible to select a solid line, i.e., one of the theoretical type curves, that corresponds most closely to each set of simulated points. A value of $\Delta t_{p1}/\Delta t_s$ was chosen for each of these type curves. After determining $\Delta t_{p1}/\Delta t_s$ from the chart and hence calculating $\Delta t_{p1}$, we used the equation below to solve for total permeability k'.

$$k' = -70.64 q B \mu W(-23.9 \varphi c_t r_w^2 h \Delta p_p / q B \Delta t_{p1}) / h \Delta p_p \quad (7)$$

where W is the Lambert-W function.

The results indicate a very close agreement between k' and the formation permeability k. In Case A, the well contains no skin damage. In Cases B and C, the wells contain skin damage and skin enhancement respectively. The well with skin damage (+2) has an impaired value of total permeability (k'=55 mD vs. k=80 mD). The well with reservoir stimulation (−2) has an enhanced permeability (k'=157 mD vs. k=80 mD).

These examples demonstrate that the total, averaged permeability k' can be used to diagnose problematic wells with only fluid pound pressure data available.

The methods of the present disclosure have the advantage of allowing approximate determination of reservoir properties at low cost, using frequently available production data. As aging oil fields frequently have hundreds of wells producing under artificial lift, it is not economical to perform a traditional well test on all wells. Using the disclosed methods, it is possible to test every well in a field without the expense of a pressure build up (PBU) survey and the associated lost production. The methods are useful for identifying wells with high skin or low permeability.

Furthermore, use of the methods of the present disclosure results in the ability to identify areas of a reservoir where upside potential remains, and which wells can be enhanced through stimulation, e.g., acidizing. This can result in increased oil production.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof.

Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A method for assessing the productivity of an intermittently produced beam pumped hydrocarbon producing well while operating the well wherein the well has a percentage run time and a number of production cycles over a given period of time, comprising:

(a) operating a well at production pumping conditions;

(b) monitoring a pressure signal and/or a production rate signal in the well during operation of the well without shutting in the well such that no production loss is incurred to obtain well data;

(c) operating the well with a pump off controller such that the well is periodically started and stopped;

(d) plotting a set of theoretical type curves using a type curve algorithm that successively solves for the duration of each producing time $\Delta t_{(Dp)N}$, represented as:

Solving for $\Delta t_{(D_p)N}$ $$\left\{\begin{array}{ll} 0.4452*10^{0.868(PD_p-s)}=\Delta t_{(D_p)1}, & N=1 \\ 0.4452*10^{0.868(PD_p-s)}=\dfrac{\prod_{i=1}^{N}\left[\sum_{j=1}^{N}\left(\Delta t_{(D_p)j}\right)+(N-i)\Delta t_{(D_p)}\right]}{\prod_{i=2}^{N}\left[\sum_{j=1}^{N}\left(\Delta t_{(D_p)j}\right)+(N+1-i)\Delta t_{(D_p)}\right]}, & N>1 \end{array}\right\};$$

where:

$p_{Dp}$ represents a fluid pound pressure in psi;

s represents skin;

$\Delta t_{Dp}$ represents a producing time;

N represents a number of the production period; and $\Delta t_{Ds}$ represents a shut-in time;

(e) plotting a dimensionless curve of the percentage run time versus the number of production cycles for the well;

(f) identifying which of the set of theoretical type curves best fits the dimensionless curve;

(g) determining $\Delta t_{p1}/\Delta t_s$ corresponding to the type curve identified in step (f) wherein $\Delta t_{p1}$ is the amount of time for a first production period of the well and $\Delta t_s$ is an operator defined shut in period;

(h) calculating $\Delta t_{p1}$ from the dimensionless curve;

(i) calculating a well property selected from the group consisting of total permeability, skin, productivity index and combinations thereof using the well data obtained in step (b) and $\Delta t_{p1}$ calculated in step (h); and (j) utilizing the well property obtained in step (i) to identify repairs needed to the well to enhance the recovery of hydrocarbons from the well.

2. The method of claim 1, further comprising:

(k) conducting the identified repairs to the well.

3. The method of claim 2, wherein the repairs to the well are part of a workover program for maintaining the well.

4. The method of claim 2 wherein the conducted repairs comprise retrieving tubing and rods from the well, thereby enhancing the recovery of hydrocarbons from the well.

5. The method of claim 2 wherein the conducted repairs comprise pumping treatment fluids into a rock formation surrounding the well to repair low permeability areas in the rock formation, thereby enhancing the recovery of hydrocarbons from the well.

6. The method of claim 1, wherein the well property is total permeability k' and wherein total permeability is calculated using the equation:

$$k'=-70.64qB\mu W(-23.9\varphi c_t r_w^2 h\Delta p_p/qB\Delta t_{p1})/h\Delta p_p;$$

where:

q represents a fluid rate in bbl/day;

B represents a formation volume factor in rb/stb;

μ represents a viscosity in cP;

W represents a Lambert-W function;

φ represents a porosity in pu;

$c_t$ represents a total compressibility in $psi^{-1}$;

$r_w$ represents a radius of wellbore in ft;

h represents a thickness in ft;

$\Delta p_p$ represents a difference between initial reservoir pressure and fluid pound pressure in psi; and $\Delta t_{p1}$ represents a first cycle production time in hours.

7. The method of claim 6 further comprising utilizing the total permeability as calculated to identify remediation needed at the well wherein remediation is needed when the total permeability as calculated is lower than a desired permeability.

8. A system for controlling production of a hydrocarbon producing well, comprising:

(a) a beam pump for lifting fluid from a hydrocarbon producing well;

(b) a pump off controller for controlling the operation of the beam pump based on pre-set conditions determined by an operator such that when pump-off is detected in the hydrocarbon producing well, the beam pump is shut down for a pre-set amount of time to allow entry of fluid into the hydrocarbon producing well; wherein the pump off controller comprises sensors for gathering well data comprising a percentage run time and a number of production cycles over a given period of time and microprocessors;

(c) a processor for plotting a dimensionless curve of the percentage run time versus the number of production cycles over the given period of time and for solving one or more equations to obtain a well property selected from the group consisting of total permeability, skin, productivity index and combinations thereof;

(d) a set of theoretical type curves plotted using a type curve algorithm that successively solves for the duration of each producing time $\Delta t_{(Dp)N}$, represented as:

Solving for $\Delta t_{(D_p)N}$ $$\begin{cases} 0.4452 * 10^{0.868(PD_p - s)} = \Delta t_{(D_p)1}, & N = 1 \\ 0.4452 * 10^{0.868(PD_p - s)} = \dfrac{\prod_{i=1}^{N}\left[\sum_{j=1}^{N}(\Delta t_{(D_p)j}) + (N-i)\Delta t_{(D_p)}\right]}{\prod_{i=2}^{N}\left[\sum_{j=1}^{N}(\Delta t_{(D_p)j}) + (N+1-i)\Delta t_{(D_p)}\right]}, & N > 1 \end{cases}$$

where:

s represents skin;

$p_{Dp}$ represents a fluid pound pressure in psi;

$\Delta t_{Dp}$ represents a producing time;

N represents a number of the production period; and $\Delta t_{Ds}$ represents a shut-in time;

such that the dimensionless curve of the percentage run time versus the number of production cycles over the given period of time can be compared to the set of theoretical type curves to identify which of the set of theoretical type curves best fits the dimensionless curve; and (e) a repair unit for executing a repair to the hydrocarbon producing well based on analysis of the well data.

9. The system of claim 8 wherein the well property is total permeability k' and wherein total permeability is solved by the processor according to the equation:

$$k' = -70.64 qB\mu W(-23.9\varphi c_t r_w^2 h\Delta p_p / qB\Delta t_{p1})/h\Delta p_p;$$

where:

q represents a fluid rate in bbl/day;

B represents a formation volume factor in rb/stb;

μ represents a viscosity in cP;

W represents a Lambert-W function;

φ represents a porosity in pu;

$c_t$ represents a total compressibility in $psi^{-1}$;

$r_w$ represents a radius of wellbore in ft;

h represents a thickness in ft;

$\Delta p_p$ represents a difference between initial reservoir pressure and fluid pound pressure in psi; and $\Delta t_{p1}$ represents a first cycle production time in hours.

10. The system of claim 8 wherein the pump-off is detected in the hydrocarbon producing well by a load cell strain gauge for measuring load on the beam pump wherein the load cell strain gauge is connected to the pump off controller by a line.

11. The system of claim 8 wherein the repair unit is a work-over rig for replacing components of a well completion.

12. The system of claim 11 wherein the work-over rig comprises a derrick tower, one or more spools of cable, a diesel engine or a mud pump, and one or more mud tanks.

* * * * *